US005944445A

United States Patent [19]

Montgomery

[11] Patent Number: 5,944,445

[45] Date of Patent: Aug. 31, 1999

[54] DEVICE AND METHOD FOR RELIEVING FLOODING FROM ENCLOSED SPACE

[75] Inventor: Martin J. Montgomery, Avalon, N.J.

[73] Assignee: Smart Vent, Inc., Avalon, N.J.

[21] Appl. No.: 09/079,611

[22] Filed: May 15, 1998

Related U.S. Application Data

[60] Provisional application No. 60/052,819, Jul. 10, 1997.

[51] Int. Cl.[6] ..... E02B 7/20; E02B 7/40

[52] U.S. Cl. ..... 405/92; 405/87; 405/94; 52/573.1

[58] Field of Search ..... 405/87, 92, 94, 405/95, 96, 99, 100, 101, 102; 454/237, 238, 273, 271; 52/573.1, 1, 19, 169.5, 302.1, 473

[56] References Cited

U.S. PATENT DOCUMENTS

| | | | |
|---|---|---|---|
| 100,623 | 3/1870 | Hays . | |
| 850,441 | 4/1907 | McGinnis | 405/92 |
| 911,290 | 2/1909 | Burkett . | |
| 2,105,735 | 1/1938 | Hodge | 189/71 |
| 2,118,535 | 5/1938 | Betts | 61/26 |
| 2,565,122 | 8/1951 | Cowan | 98/118 |
| 2,611,310 | 9/1952 | Cowan | 98/118 |
| 2,754,747 | 7/1956 | Bertling | 98/106 |
| 2,774,116 | 12/1956 | Wolverton | 20/16 |
| 2,798,422 | 7/1957 | Bourque | 98/87 |
| 3,123,867 | 3/1964 | Combs | 20/16 |
| 3,425,175 | 2/1969 | Gerde | 52/169 |
| 3,680,329 | 8/1972 | Burtis | 62/275 |
| 3,939,863 | 2/1976 | Robison | 137/357 |
| 3,942,328 | 3/1976 | Bunger | 405/96 |
| 4,116,213 | 9/1978 | Kamezaki | 137/360 |
| 4,174,913 | 11/1979 | Schliesser | 405/94 |
| 4,227,266 | 10/1980 | Russell | 4/496 |
| 4,349,296 | 9/1982 | Langeman | 405/99 |
| 4,549,837 | 10/1985 | Herbert | 405/101 |
| 4,669,371 | 6/1987 | Sarazen, Jr. et al. | 98/29 |
| 4,676,145 | 6/1987 | Allred | 454/276 |
| 4,699,045 | 10/1987 | Hensley | 454/313 |
| 4,754,696 | 7/1988 | Sarazen et al. | 52/573 |
| 5,171,102 | 12/1992 | De Wit | 405/100 X |
| 5,253,804 | 10/1993 | Sarazen et al. | 454/256 X |
| 5,293,820 | 3/1994 | Vagedes | 160/89 |
| 5,294,049 | 3/1994 | Trunkle et al. | 454/351 X |
| 5,330,386 | 7/1994 | Calandra | 454/341 |
| 5,460,572 | 10/1995 | Waltz et al. | 454/273 |
| 5,487,701 | 1/1996 | Schnedegger et al. | 454/271 |

*Primary Examiner*—Tamara Graysay
*Assistant Examiner*—Jong-Suk Lee
*Attorney, Agent, or Firm*—Quarles & Brady

[57] ABSTRACT

A flood gate for use in a foundation crawl space and the like comprises a frame having side walls defining a fluid passageway therethrough, a door pivotally mounted in the frame for bidirectional rotation between two open positions and a closed position therebetween to permit tidal water flow therethrough, and at least one catching assembly for holding the door in the closed position against a minimum level of pressure of the tidal water flow. Tidal flood waters exceeding the minimum pressure level are automatically vented through the crawl space and the like reducing a risk of structural damage from the tidal flood waters. The flood gate can further comprise a door having a ventilation opening, an automatic louver assembly for controlling air flow through the opening, and a screen covering the opening. The automatic louver assembly opens and closes responsive to ambient temperature.

11 Claims, 8 Drawing Sheets

DEVICE AND METHOD FOR RELIEVING FLOODING FROM ENCLOSED SPACE

CROSS REFERENCE TO RELATED APPLICATION

This is a continuation of provisional application number 60/052,819 filed Jul. 10, 1997.

BACKGROUND OF THE INVENTION

1. Field of the Invention

This invention relates generally to crawl space and basement venting, and in particular, to the flood venting of enclosed spaces within a foundation.

2. Description of Related Art

Building Officials and Code Administrators (BOCA) regulations mandate that buildings with subgrade level, enclosed spaces, such as crawl spaces and basements, located in low-lying coastal flood areas, provide for adequate relief from tidal flood waters stemming from oncoming tides and receding waters. As a solution to the problem of tidal flood waters, local regulations and good construction practice employ the use of venting which, while allowing for tidal waters to ebb and flow through the enclosed space, the venting does not allow access to small animals, insects, and other pests through the openings in the enclosed space. In particular, BOCA regulations require flood venting for all new construction in low lying coastal flood areas. Furthermore, BOCA regulations require the use of flood venting where renovations to an existing structure exceed fifty percent of the value of the property.

Notwithstanding, good construction practice also embraces the use of vents which can be opened during warmer months to allow for air ventilation to permit moisture to escape from crawl spaces, while retaining the ability to close during colder months to prevent the circulation of cold air around exposed plumbing in crawl spaces. Thus, because the use of screening and louvers is necessary to achieve both the warm weather and cold weather requirements of proper venting, a flood vent must be able to automatically remove the louver and screen barrier when confronted with free flowing tidal flood water.

Generally, there have been developed a wide variety of devices which may be utilized to provide pressure relief from both liquid and gaseous forces. With respect to gas pressure relief devices, U.S. Pat. No. 3,680,329, issued Aug. 1, 1972 to is Burtis for PRESSURE EQUALIZING VALVE, disclosed a device to relieve overpressure and underpressure in the opening and closing of a door of a refrigerated space. U.S. Pat. No. 2,774,116, issued Dec. 18, 1956 to Wolverton for DOUBLE ACTING RELIEF VALVE, U.S. Pat. No. 2,798,422, issued Jul. 9, 1957 to Bourque for AIR RELIEF MEANS FOR DOORS, and U.S. Pat. No. 3,123,867, issued Mar. 10, 1964 to Combs for VESTIBULE PRESSURE EQUALIZER related to the equalization of differential air pressure experienced in the swinging of one door relative to another door. Finally, U.S. Pat. No. 2,105,735, issued Jan. 18, 1938 to Hodge for PRESSURE RELEASING APPARATUS, and U.S. Pat. No. 4,116,213, issued Sep. 26, 1978 to Kamezaki for AIR PRESSURE CONTROL APPARATUS FOR A HOT OR COLD STORAGE CHAMBER, taught methods to release pressure in closed chambers resulting from changing temperatures within the chamber. In particular, the Kamezaki apparatus utilized a swinging damper hinged at the top of an enclosing frame. Nevertheless, neither the Kamezaki apparatus nor other inventions contemplated the use of a vented damper able to relieve pressure resulting from fluid flow.

Correspondingly, several devices have been developed which provide relief from overpressure resulting from the flow of water and other liquids. U.S. Pat. No. 4,349,296, issued Sep. 14, 1982 to Langeman for IRRIGATION DITCH GATE described a gate for an irrigation ditch, which during normal conditions, through the use of tensioned springs, maintained flood gates in a closed position, but upon flood conditions, allowed for the gates to open. U.S. Pat. No. 3,939,863, issued Feb. 24, 1976 to Robison for BASEMENT SUMP CONSTRUCTION disclosed a basement drain containing a trap for the prevention of back flow of flood water. U.S. Pat. No. 4,174,913, issued Nov. 20, 1979 to Schliesser for ANIMAL GUARD FOR FIELD PIPE related to an invention which, while allowing for the free-flow exit of debris carrying effluents from an open pipe end, prevented animal entry into the pipe. Still, none of the aforementioned devices contemplated the integration of a liquid flow control device with a temperature controlled ventilation system.

Presently, several patents disclose methods for ventilating enclosed foundation spaces. U.S. Pat. No. 5,293,920, issued Mar. 15, 1994 to Vagedes for LOUVERED BASEMENT VENT, and U.S. Pat. No. 5,487,701, issued Jan. 30 1996 to Schedegger et al. for PLASTIC FOUNDATION VENT, embody louvered basement vents which can be manually adjusted to limit air flow in colder temperatures, and to maximize air flow in hotter conditions. U.S. Pat. No. 5,460,572, issued Oct. 24, 1995 to Waltz et al. for FOUNDATION VENTILATOR, discloses merely a one-piece molded plastic foundation ventilator without louvers. The Waltz invention, however, contemplates the manual use of hinged doors to regulate air flow through to the foundation. Finally, U.S. Pat. No. 2,754,747, issued Jul. 17, 1956 to Bertling for AIR REGISTER OR LOUVER, embodies a hinged, louvered door, designed to facilitate the maintenance of the screen behind the louvered door. Nonetheless, the louvers are designed to be operated manually by the user.

All of the aforementioned foundation ventilators contain screening to prevent small animals, insects and other pests from gaining access to the enclosed area. Significantly, none of the aforementioned foundation ventilators will act as a water pressure relief valve in response to the ebb and flow of tidal waters. Furthermore, none provide for the automatic adjustment of louvers in response to increasing or decreasing temperature so as to prevent either the rotting of the elements of the structure's foundation, or the freezing of pipes within the enclosed space. Accordingly, the prior art has not provided an integrated method to automatically ventilate an enclosed space of a foundation while allowing for the relief of liquid pressure on either side of the vent, and preventing small animals, insects and pests from entering the enclosed space.

SUMMARY OF THE INVENTION

The subject invention has advantages over all current air vents now used and provides a novel and nonobvious opening for the entry and exit of tidal flood waters. The maintenance free flood vent can be installed in new and existing crawl spaces and foundations and can remain in use year round. These vents have particular utility in areas designated by the Federal Emergency Management Agency (FEMA) as low lying, flood areas. When installed, the vent will allow for the free passage of air ventilation in warm temperatures and the temperature controlled louvers will close fully in colder temperatures.

Also, the louvered panel will be screened to prevent penetration by small animals, insects, and other pests and will operate like a pivotally connected gate. The panel can be secured in the closed position through the use of collapsible catches which enable the panel to snap open in either direction depending on the direction of the current of the flood water. The amount of pressure required to open the flood vent is determined by coastal construction regulations, FEMA, and good construction practices and is typically 20 to 25 lbs. as measured when the vents are in the closed position.

A vent in accordance with an inventive arrangement can remain open for regular air ventilation in warm weather conditions, can close to block off air flow during cold weather conditions and can, at any time, snap open to enable the passage of flood water into and out of the crawl space.

A flood gate for use in a foundation crawl space and the like comprises a frame having side walls defining a fluid passageway therethrough, a door pivotally mounted in the frame for bidirectional rotation between two open positions and a closed position therebetween to permit tidal water flow therethrough, and at least one catching assembly, also referred to as a latching mechanism, for holding the door in the closed position against a minimum level of pressure of the tidal water flow, whereby tidal flood waters exceeding the minimum pressure level are automatically vented through the crawl space and the like reducing a risk of structural damage from the tidal flood waters. A flood gate advantageously comprises a door having a ventilation opening, an automatic louver assembly for controlling air flow through the opening, and a screen covering the opening. An automatic louver assembly opens and closes responsive to ambient temperature.

A method for integrating ventilation of an enclosed space and relief from tidal flooding of an enclosed space comprises the steps of: maintaining a vent door in a closed position absent tidal flooding, automatically opening and closing vents in the vent door in response to changes in ambient temperature and opening the vent door in response to sufficient pressure exerted by flood waters during tidal flooding. The automatic adjusting of vents comprises the steps of: automatically sensing ambient temperature, automatically opening the vents in response to warmer ambient temperatures, and automatically closing the vents in response to cooler ambient temperatures. The method can further comprise: automatically biasing the vent door to the closed position, releasably latching the vent door in the closed position, and allowing the vent door to swing open in the direction of the tidal flow.

BRIEF DESCRIPTION OF THE DRAWINGS

Presently preferred and alternative embodiments of the inventive arrangements are shown in the drawings, it being understood, however, the inventive arrangements are not limited to the precise arrangements and instrumentalities shown.

DETAILED DESCRIPTION OF THE PREFERRED EMBODIMENTS

Figure 6:
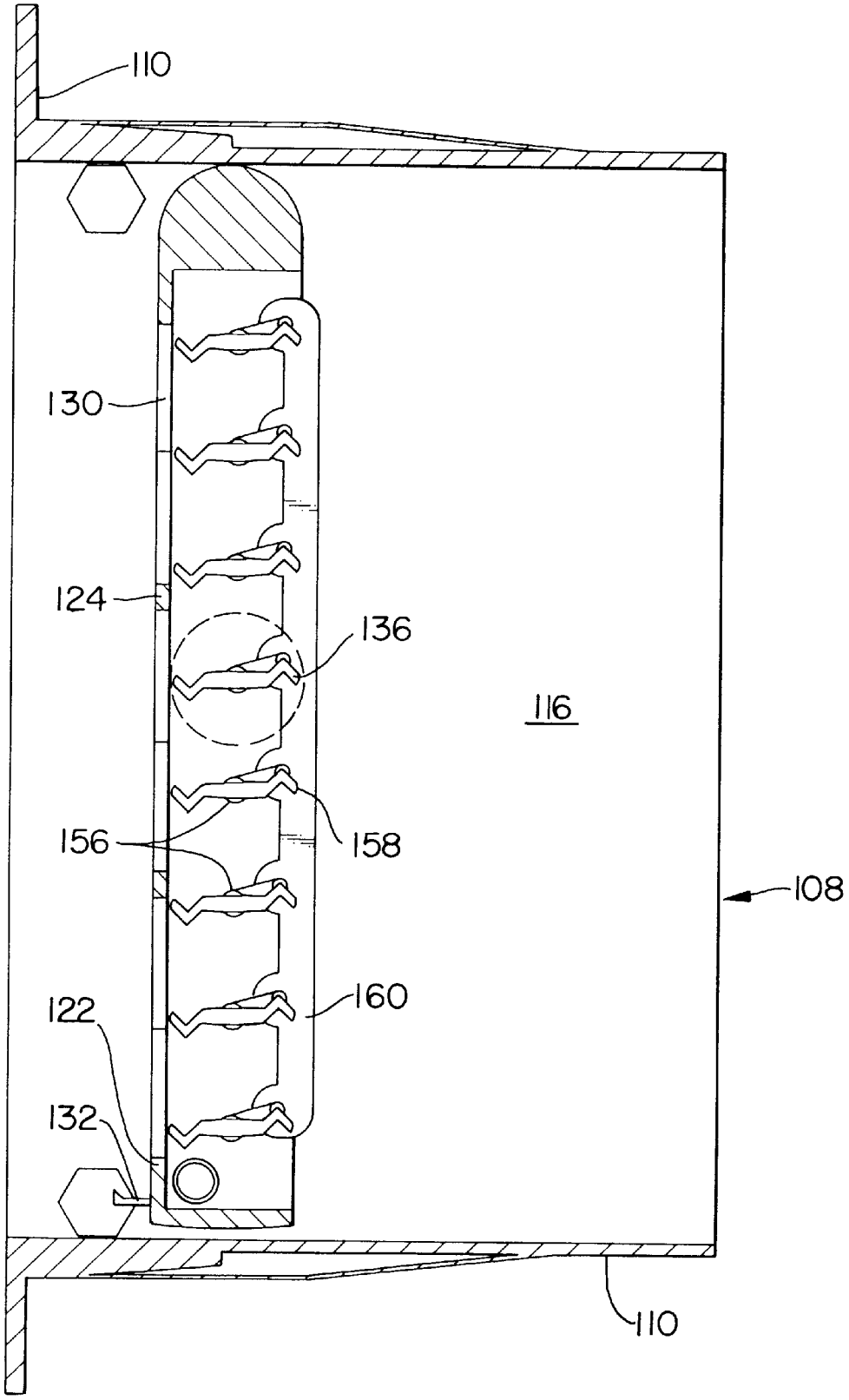
FIG. 6 is a cross section taken along the line A—A of FIG. 7.

FIG. 6 illustrates the flood vent 108 according to the preferred embodiment of an inventive arrangement. In the presently preferred embodiment, the flood vent 108 has an outer frame 110 formed with polypropylene. The dimensions of the outer frame 110 may vary from that of an 8"×16" concrete masonry unit (CMU) to 16"×16", that of two CMUs. Also in the presently preferred embodiment, the top rail 112 and the bottom rail 114 each are 16⅜" long, and the side rails 116 are 8⅜" long.

The outer frame 110 can be secured to a wall opening using stainless set screws as an example. Divots can be drilled in the masonry prior to setting screws to ensure proper security. The perimeter can be caulked as required.

Figure 7:
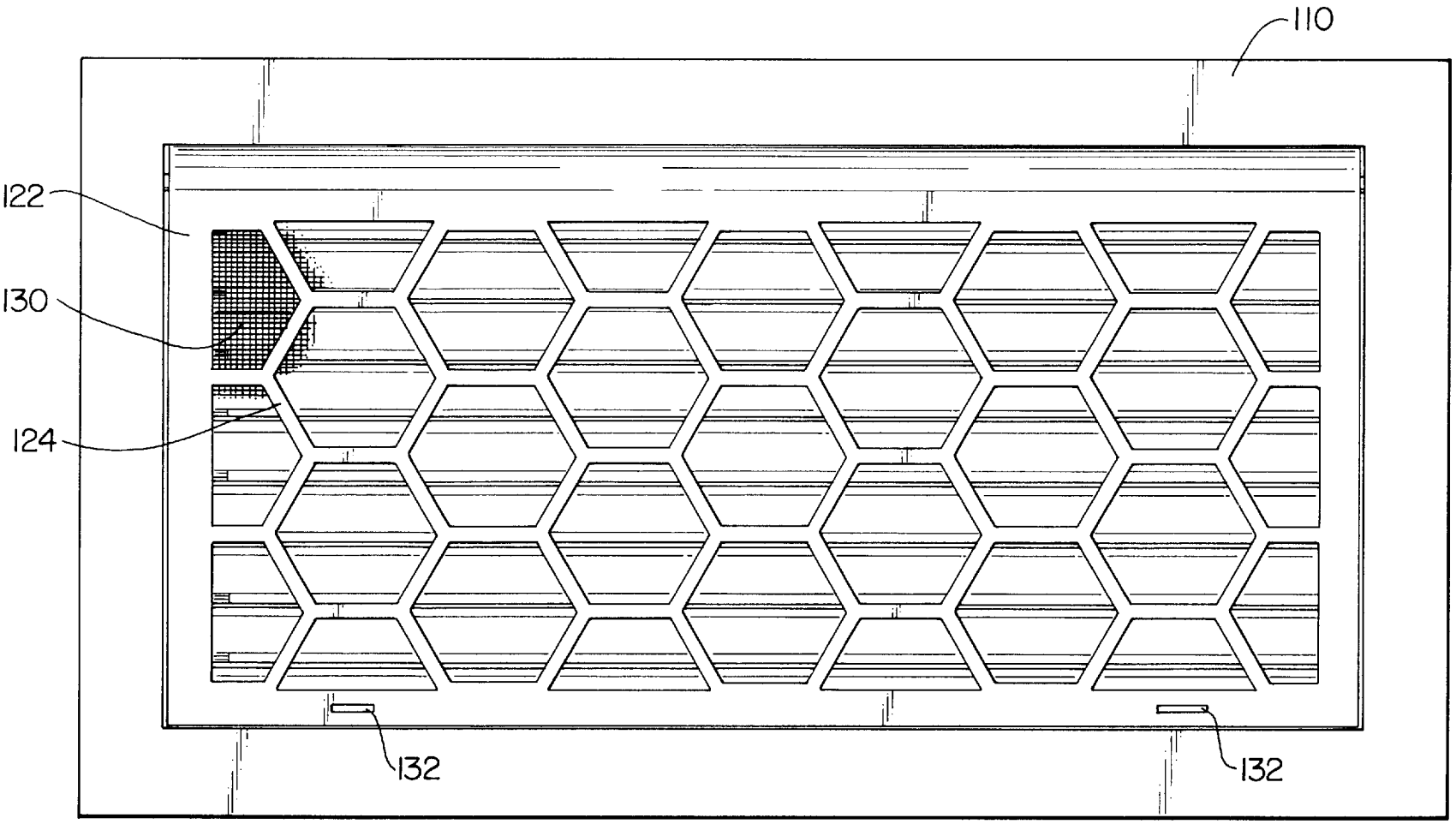
FIG. 7 is a front elevation of the preferred embodiment of the invention.

FIG. 7 illustrates the components of the door 122 made with a lightweight, corrosion-resistant material such as molded polypropylene. The door 122 comprises a honeycomb-patterned mesh grille 124 backed by screening 130, for example made from stainless steel. A pair of opposing pull tabs 132 are attached to the mesh grille 124.

Figure 8:
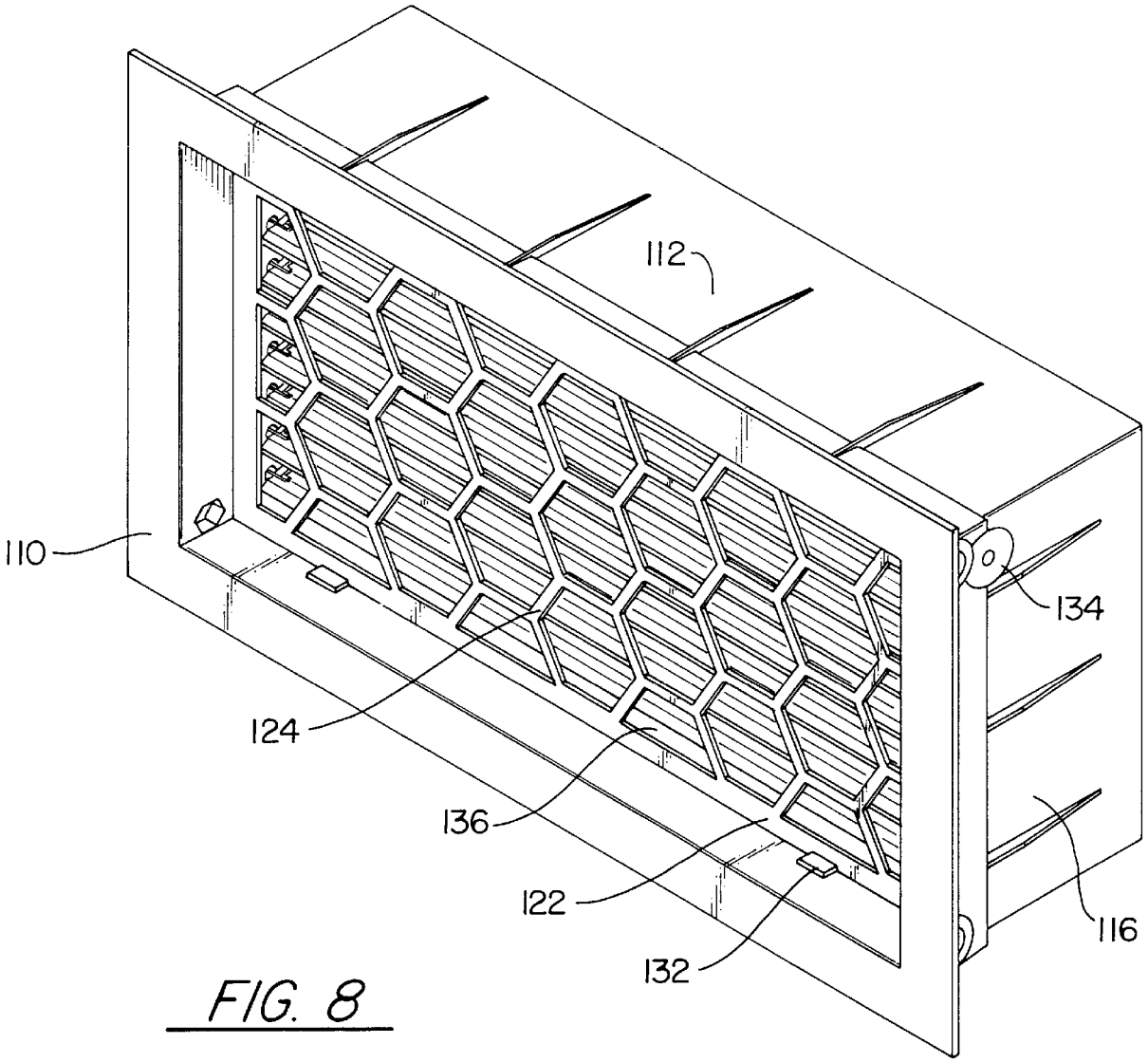
FIG. 8 is an isometric elevation of the front panel and frame connection detail shown in FIG. 7.

FIG. 8 illustrates an isometric view of the front side elevation. The outer frame 110 houses the door panel 122. The smaller door panel 122 connects to the outer frame 110 by pivot points 134 which extrude from the top of the door panel 122.

Figure 9:
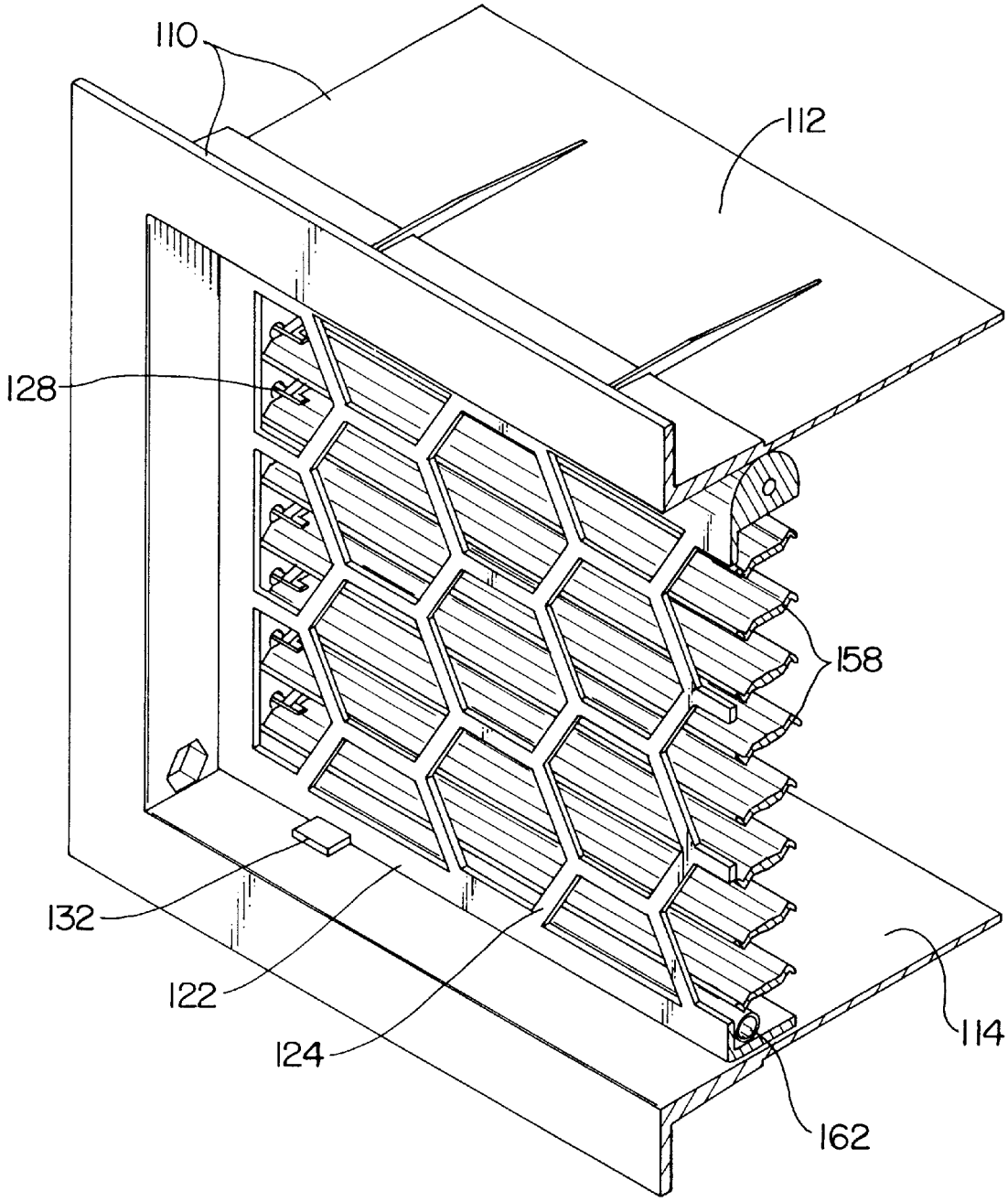
FIG. 9 is a cross section cut through the midpoint of the isometric elevation of the front panel shown in FIG. 8.

FIG. 9 illustrates the equally spaced positioning of the finned, polypropylene louvers 158 within the door frame 128. A vertical rod 160, made from a lightweight, corrosion-resistant, strong material, such as polypropylene, couples the finned louvers 158 to a temperature sensitive actuating device 136 mounted on a louver 158 at the midsection of the panel door 122. The temperature sensitive actuating device 136, so named because the device translates thermal inputs into physical motion, is adjusted to drive the finned louvers 158 open during warm temperatures and to fully close the louvers when the temperature falls below forty degrees Fahrenheit.

Figure 10:
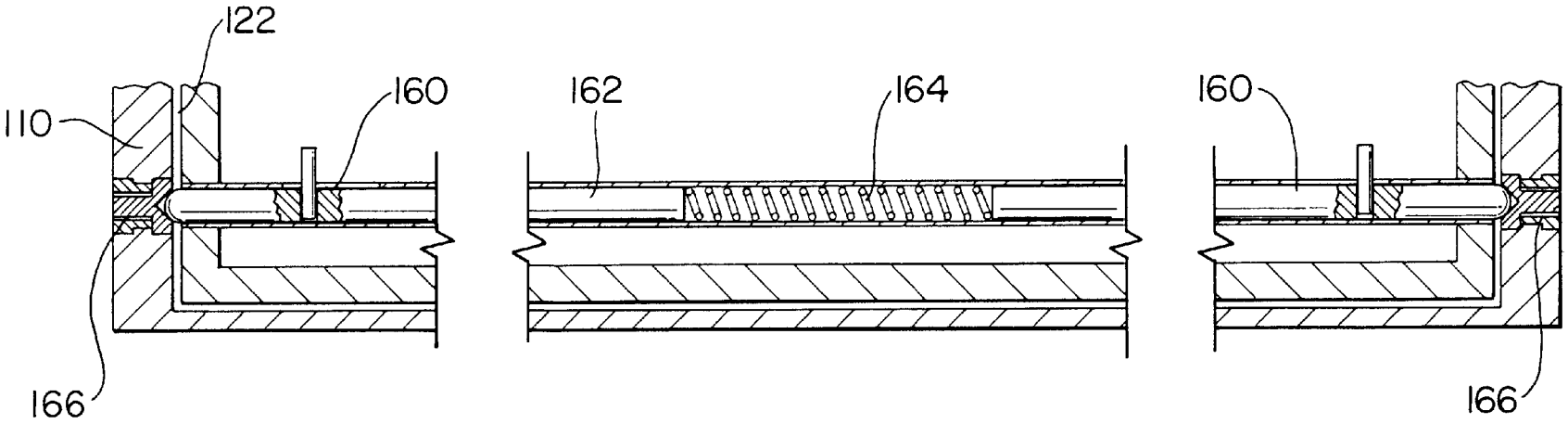
FIG. 10 is a detail section cut through the latching mechanism.

FIG. 10 illustrates a detail section cut through the latching mechanism. The latching mechanism comprises of two rods 160 and an inner spring 164, inserted into a hollow rod 162 which has been sized to house the rods 160 and spring 164. Both tips of the rods 160 are rounded. The tips extend past the edge of the door panel so as to be received by detent sleeves 166 extruding from both side rails 116.

Figure 1:
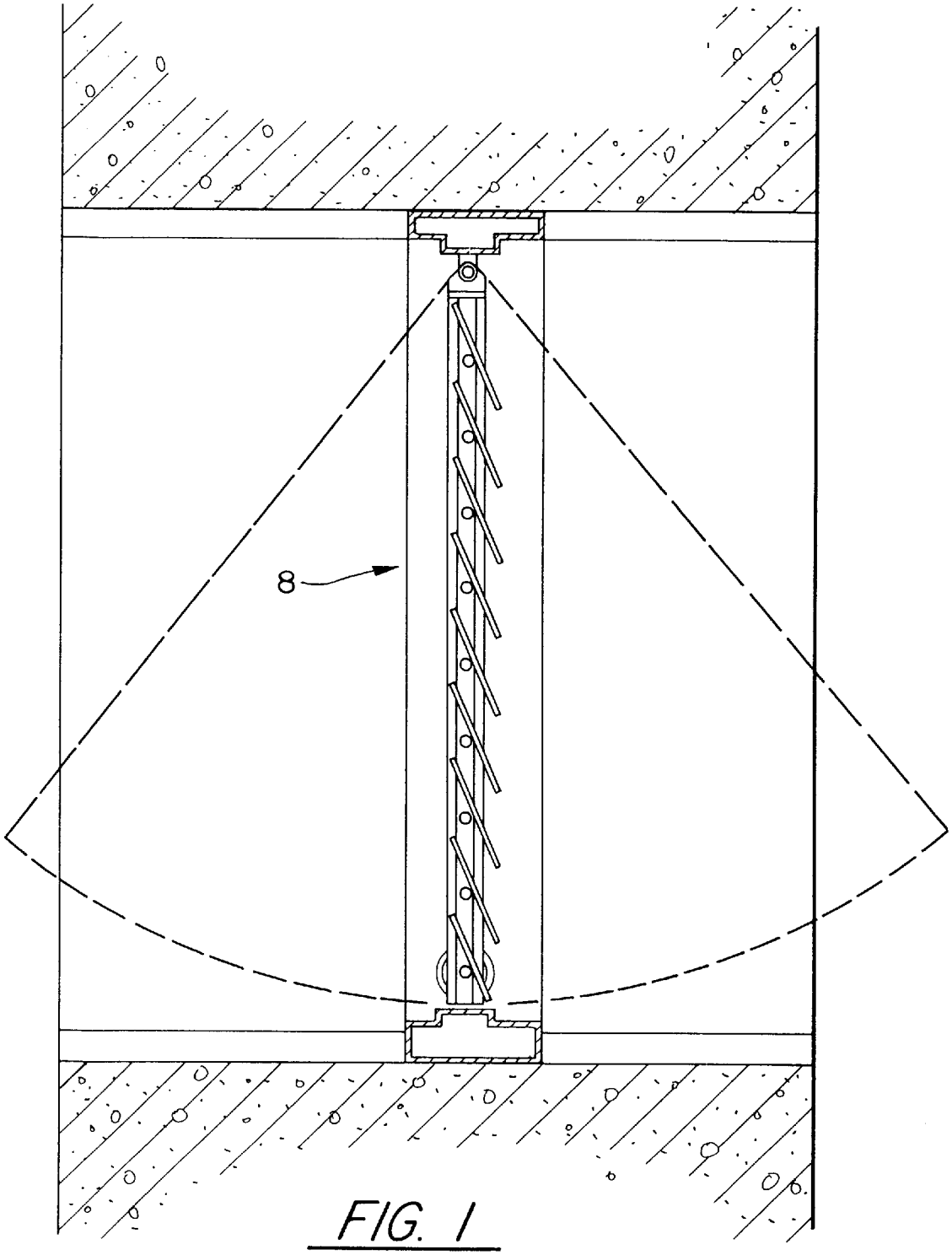
FIG. 1 is a cross section taken along the line A—A of FIG. 2.

FIG. 1 illustrates an alternative embodiment of a flood vent 8 according to an inventive arrangement. In the alternative embodiment, the flood vent 8 is framed by an outer frame 10 which is formed with 1" thick by 3" wide strips of a lightweight, corrosion-resistant material such as polypropylene. The dimensions of the outer frame 10 are equal to that of an 8"×16" concrete masonry unit (CMU). Also in the alternative embodiment, the top rail 12 and the bottom rail 14 each are 16⅜" long, and the side rails 16 are 8⅜" long.

A 1" wide extrusion 18 on the inner surface 20 of the outer frame 10 receives the door 22. The outer frame 10 can be secured to a wall opening using stainless set screws as an example. Divots can be drilled in the masonry prior to setting screws to ensure proper security. The perimeter can be caulked as required.

Figure 2:
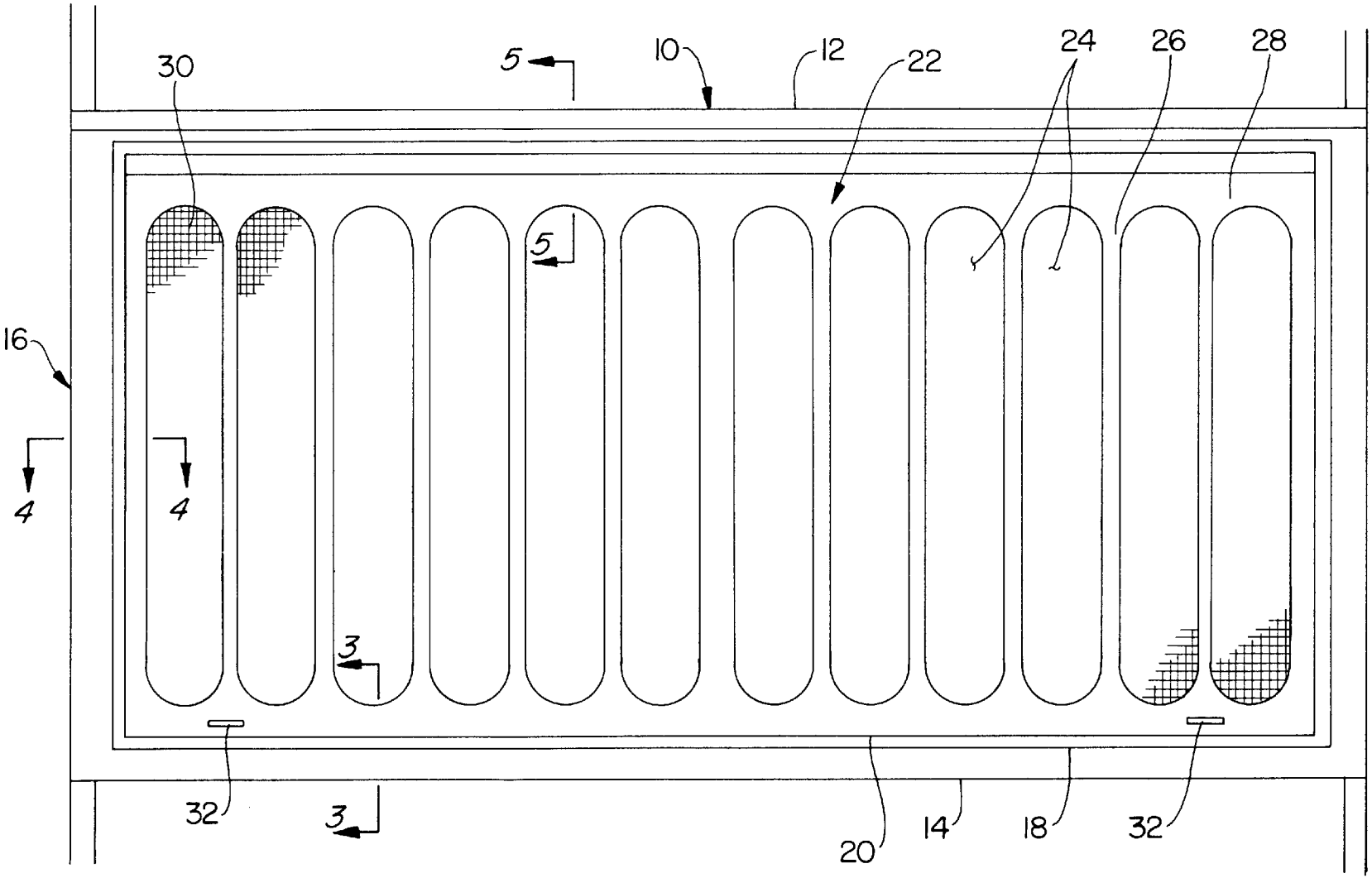
FIG. 2 is a front elevation of the alternative embodiment of the invention.
Figure 4:
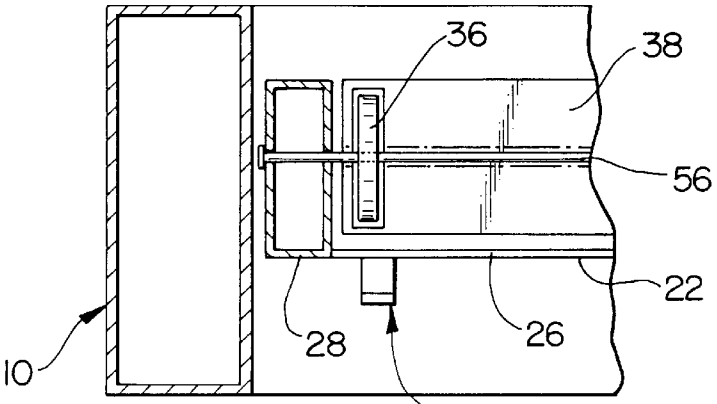
FIG. 4 is a right side elevation of the rod connection detail shown in FIG. 1.

FIG. 2 illustrates the components of the door 22 made with a lightweight, corrosion-resistant material such as polypropylene. The door 22 comprises a grille pattern 24 defined by a louver panel 26 and a door frame 28 surrounding the louver panel 26. The grille pattern 24 is backed by screening 30, for example, made from aluminum. A pair of opposing pull tabs 32 are attached to the door frame 28.

Figure 3:
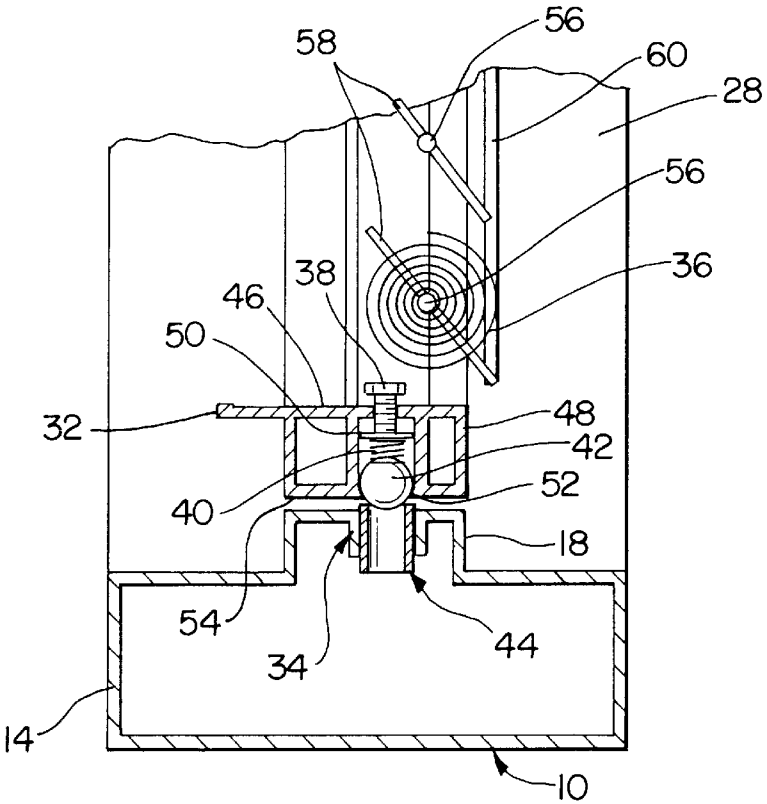
FIG. 3 is a right side elevation of the catching assembly mechanism detail shown in FIG. 1.

FIG. 3 illustrates a detailed view of the catching assembly 34 and the temperature sensitive actuating device 36. The catching assembly 34 comprises an adjustable screw 38, a catch spring 40, a ball bearing 42 made from stainless steel, and a threaded sleeve 44. The adjustable screw 38 is threaded through the top surface 46 of the lower door frame 48 into a cavity 50 in the lower door frame 48. The cavity 50 holds the catch spring 40 and the ball bearing 42. An opening 52 with a diameter less than the diameter of the ball bearing 42 is between the cavity 50 and the lower surface 54 of the lower door frame 48. The sleeve 44 is threaded into the extrusion 18 on the bottom rail 14. The adjustable screw 38 varies the compression of the catch spring 40, and the catch spring 40 pushes the ball bearing 42 partially through the opening 52. The sleeve 44 accepts the portion of the ball bearing 42 that extends through the opening 52.

Multiple horizontal rods 56 made from aluminum extend through the door 22 and are attached to the door frame 28. The horizontal rods 56 are equally spaced within the door frame 28. Finned louvers 58 are attached to all of the horizontal rods 56. A vertical rod 60, made from a lightweight and strong material such as aluminum, attaches the finned louvers 58 to a temperature sensitive actuating device 36, SO named because the device translates thermal inputs into physical motion. The temperature sensitive actuating device 36 is mounted on the bottom-most horizontal rod 56, and is adjusted to drive the finned louvers 58 open during warm temperatures and to fully close the louvers when the temperature falls below forty degrees Fahrenheit.

Figure 5:
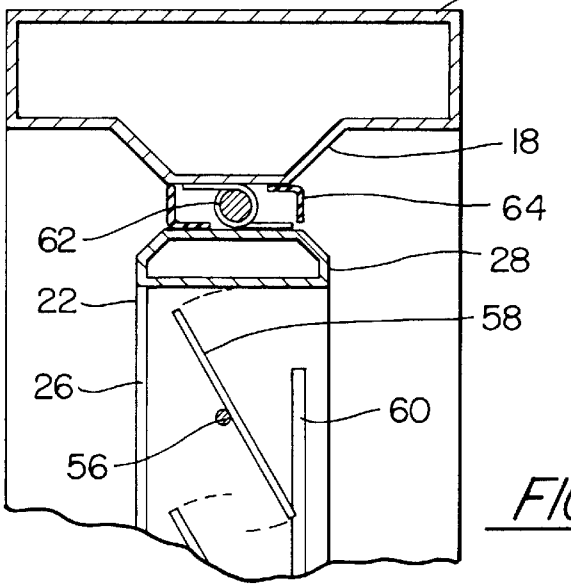
FIG. 5 is a cross section taken along the line C—C of FIG. 2.

FIG. 5 illustrates a detailed view of the hinging apparatus. A spring-loaded piano hinge 62, for example made from stainless steel for corrosion resistance, rotatably connects the door frame 28 to the extrusion 18 on the top rail 12. The spring loaded piano hinge 62 can rotate up to 90 degrees in both directions. When no horizontal pressure is exerted on the door 22 the spring-loaded piano hinge 62 urges the door 22 back to a substantially vertical position. As the door 22 is urged to a substantially vertical position, the spring-loaded piano hinge 62 must have sufficient force to compress the catch spring 40 which allows the ball bearing 42 to withdraw into the opening 52 such that the ball bearing 42 can pass over the sleeve 44. The spring load is sensitive to 6 to 8 lb. of horizontal force. A front and back flexible weather strip 64 are preferably attached to the extrusion 18 adjacent the spring-loaded piano hinge 62 and to the door frame 28.

What is claimed is:

1. A flood gate for use in an enclosed space, the flood gate comprising:

a frame having side walls defining a fluid passageway therethrough;

a door pivotally mounted in said frame for bidirectional rotation between two open positions and a closed position therebetween to permit tidal water flow therethrough; and, at least one catching assembly for holding the door in said closed position against a minimum level of pressure of said tidal water flow;

whereby tidal flood waters exceeding said minimum pressure level are automatically vented through said enclosed space reducing a risk of structural damage from said tidal flood waters.

2. The flood gate according to claim 1, wherein said flood gate comprises:

said door having a ventilation opening;

an automatic louver assembly for controlling air flow through said opening; and, a screen covering said opening.

3. The flood gate according to claim 2 wherein said automatic louver assembly opens and closes responsive to ambient temperature.

4. The flood gate according to claim 2, wherein said automatic louver assembly comprises:

a plurality of louvers;

a temperature sensitive actuating device; and, a member connecting said plurality of louvers to said temperature sensitive actuating device.

5. The flood gate according to claim 2, wherein said screen comprises:

a mesh grille; and, a screening over said grille;

whereby small animals, insects and other pests are denied access to said enclosed space notwithstanding ventilation of said enclosed space.

6. The flood gate according to claim 1, wherein said catching assembly comprises:

at least one catch;

at least one resilient member; and, at least one detent sleeve;

whereby the catching assembly can maintain said door in said closed position until said minimum pressure is applied to cause the door to swing into one of said open positions.

7. The flood gate according to claim 1 wherein said enclosed space is a foundation crawl space.

8. A method for integrating ventilation of an enclosed space and relief from tidal flooding of said enclosed space, comprising the steps of:

maintaining a vent door in a closed position absent said tidal flooding;

automatically adjusting vents in said vent door in response to changes in ambient temperature; and, opening said vent door in response to sufficient pressure exerted by flood waters during said tidal flooding.

9. The method as recited in claim 8, wherein said step of automatically adjusting said vents comprises the steps of:

automatically sensing said ambient temperature;

automatically opening said vents in response to warmer ambient temperatures; and, automatically closing said vents in response to cooler ambient temperatures.

10. The method as recited in claim 8, comprising the steps of:

automatically biasing said vent door to said closed position; and, releasably latching said vent door in said closed position.

11. The method as recited in claim 8, comprising the step of allowing said vent door to swing open in the direction of said tidal flow.

* * * * *

US005944445C1

(12) EX PARTE REEXAMINATION CERTIFICATE (10038th)

United States Patent
Montgomery

(10) Number: US 5,944,445 C1
(45) Certificate Issued: Feb. 12, 2014

(54) DEVICE AND METHOD FOR RELIEVING FLOODING FROM ENCLOSED SPACE

(75) Inventor: Martin J. Montgomery, Avalon, NJ (US)

(73) Assignee: Smart Vent, Inc., Avalon, NJ (US)

Reexamination Request:
No. 90/011,829, Sep. 26, 2011

Reexamination Certificate for:

| | |
|---|---|
| Patent No.: | **5,944,445** |
| Issued: | **Aug. 31, 1999** |
| Appl. No.: | **09/079,611** |
| Filed: | **May 15, 1998** |

Related U.S. Application Data

(60) Provisional application No. 60/052,819, filed on Jul. 10, 1997.

(51) Int. Cl.
*E02B 7/20* (2006.01)
*E02B 7/40* (2006.01)

(52) U.S. Cl.
USPC ..... 405/92; 405/87; 405/94; 52/573.1

(58) Field of Classification Search
None
See application file for complete search history.

(56) References Cited

To view the complete listing of prior art documents cited during the proceeding for Reexamination Control Number 90/011,829, please refer to the USPTO's public Patent Application Information Retrieval (PAIR) system under the Display References tab.

*Primary Examiner* — Sara Clarke

(57) ABSTRACT

A flood gate for use in a foundation crawl space and the like comprises a frame having side walls defining a fluid passageway therethrough, a door pivotally mounted in the frame for bidirectional rotation between two open positions and a closed position therebetween to permit tidal water flow therethrough, and at least one catching assembly for holding the door in the closed position against a minimum level of pressure of the tidal water flow. Tidal flood waters exceeding the minimum pressure level are automatically vented through the crawl space and the like reducing a risk of structural damage from the tidal flood waters. The flood gate can further comprise a door having a ventilation opening, an automatic louver assembly for controlling air flow through the opening, and a screen covering the opening. The automatic louver assembly opens and closes responsive to ambient temperature.

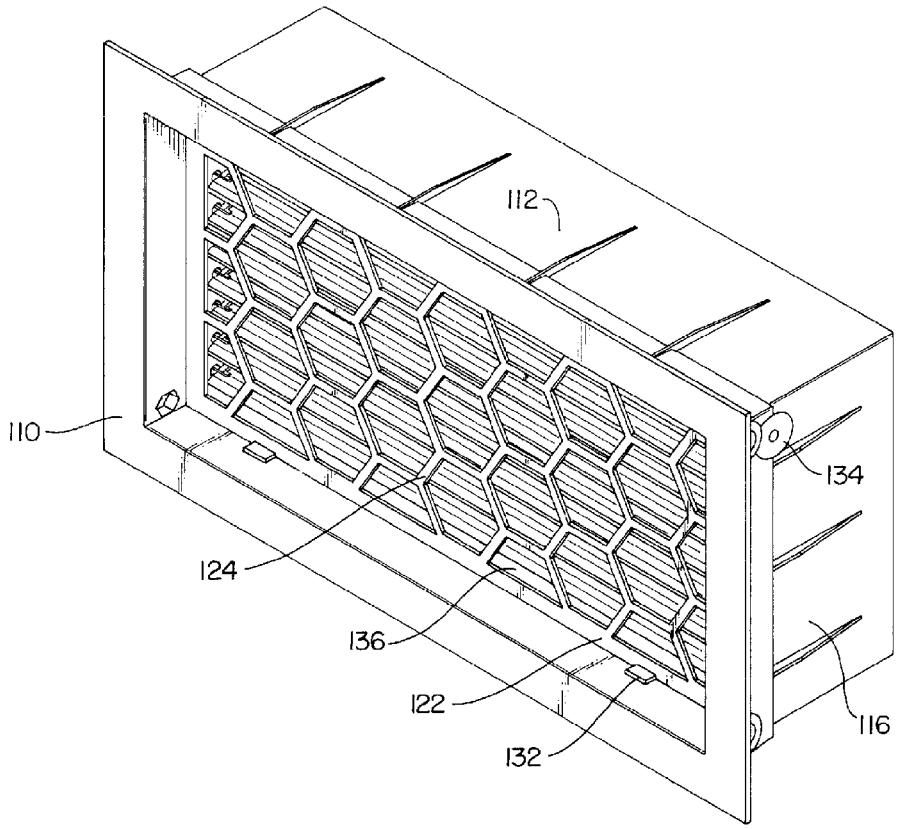

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2 and 7 are cancelled.

Claims 1, 3, 4, 5, 6 and 8 are determined to be patentable as amended.

Claims 9, 10 and 11, dependent on an amended claim, are determined to be patentable.

New claims 12-15 are added and determined to be patentable.

1. A flood gate for use in an enclosed space, the flood gate comprising:

a frame having side walls defining a fluid passageway therethrough;

a door pivotally mounted in said frame for bidirectional rotation between two open positions and a closed position therebetween to permit tidal water flow therethrough;

*said door having a ventilation opening;*

*an automatic louver assembly for controlling air flow through said opening;* and, at least one catching assembly for holding the door in said closed position against a minimum level of pressure of said tidal water flow;

whereby tidal flood waters exceeding said minimum pressure level are automatically vented through said enclosed space reducing a risk of structural damage from said tidal flood waters.

3. The flood gate according to claim [2] *1* wherein said automatic louver assembly opens and closes responsive to ambient temperature.

4. The flood gate according to claim [2] *1*, wherein said automatic louver assembly comprises:

a plurality of louvers;

a temperature sensitive actuating device; and, a member connecting said plurality of louvers to said temperature sensitive actuating device.

5. The flood gate according to claim [2] *1*, wherein said screen [comprises:

a mesh grille; and, a screening over said grille;

whereby] *is configured to deny* small animals[,] *and* insects [and other pests are denied] access to said enclosed space notwithstanding ventilation of said enclosed space.

6. [The flood gate according to claim 1.] *A flood gate for use in an enclosed space, the flood gate comprising:*

*a frame having side walls defining a fluid passageway therethrough;*

*a door pivotally mounted in said frame for bidirectional rotation between two open positions and a closed position therebetween to permit tidal water flow therethrough, said door having at least one ventilation opening covered by a screen that moves with the door; and,*

*at least one catching assembly for holding the door in said closed position against a minimum level of pressure of said tidal water flow;*

*whereby tidal flood waters exceeding said minimum pressure level are automatically vented through said enclosed space reducing a risk of structural damage from said tidal flood waters;* wherein said catching assembly comprises:

at least one catch;

at least one resilient member; and, at least one detent sleeve;

whereby the catching assembly can maintain said door in said closed position until said minimum pressure is applied to cause the door to swing into one of said open positions.

8. A method for integrating ventilation of an enclosed space and relief from tidal flooding of said enclosed space, comprising the steps of:

maintaining a vent door in a closed position absent said tidal flooding, *said vent door having at least one vent opening that is covered by a screen that moves with the door*;

automatically adjusting vents in said vent door in response to changes in ambient temperature; and, opening said vent door in response to sufficient pressure exerted by flood waters during said tidal flooding.

*12. A flood gate for use in an enclosed space, the flood gate comprising:*

*a frame having side walls defining a fluid passageway therethrough;*

*a door pivotally mounted in said frame for bidirectional rotation between two open positions and a closed position therebetween to permit tidal water flow therethrough, said door having at least one ventilation opening covered by a screen that moves with the door; and,*

*at least one catching assembly for holding the door in said closed position against a minimum level of pressure of said tidal water flow;*

*whereby tidal flood waters exceeding said minimum pressure level are automatically vented through said enclosed space reducing a risk of structural damage from said tidal flood waters;*

*wherein the fluid passageway has the width and height of a standard concrete masonry unit.*

*13. A flood gate for use in an enclosed space, the flood gate comprising:*

*an outer frame having four side walls defining a fluid passageway therethrough, wherein the outer frame has a width of a standard concrete masonry unit (CMU), a height of one or two CMUs, each of the four side walls having a depth of 3";*

*a door pivotally mounted in said frame for bidirectional rotation between two open positions and a closed position therebetween to permit tidal water flow therethrough; and,*

*at least one catching assembly for holding the door in said closed position against a minimum level of pressure of said tidal water flow,*

*whereby tidal flood waters exceeding said minimum pressure level are automatically vented through said enclosed space reducing a risk of structural damage from said tidal flood waters.*

*14. The flood gate according to claim 13, wherein the door comprises a door frame enclosing a louver panel.*

*15. A flood gate for use in an enclosed space, the flood gate comprising:*

*an outer frame having side walls defining a fluid passageway therethrough, wherein the outer frame has a width of a standard concrete masonry unit (CMU), a height of one or two CMUs;*

*a door pivotally mounted in said frame for bidirectional rotation between two open positions and a closed position therebetween to permit tidal water flow therethrough, wherein the door is recessed from the front and back of the outer frame, and includes a ventilation opening; and,*

*at least one catching assembly for holding the door in said closed position against a minimum level of pressure of said tidal water flow,*

*whereby tidal flood waters exceeding said minimum pressure level are automatically vented through said enclosed space reducing a risk of structural damage from said tidal flood waters.*

* * * * *